United States Patent [19]

Adams

[11] Patent Number: 4,639,970

[45] Date of Patent: Feb. 3, 1987

[54] ROLLER ASSEMBLY WITH STABILIZER ELEMENTS FOR SLIDING PANELS

[75] Inventor: Sherman C. Adams, Bradenton, Fla.

[73] Assignee: Alcan Aluminum Corporation, Cleveland, Ohio

[21] Appl. No.: 675,986

[22] Filed: Nov. 29, 1984

[51] Int. Cl.[4] ..... E05D 15/06

[52] U.S. Cl. ..... 16/90; 16/100; 16/102; 49/425

[58] Field of Search ..... 16/90, 91, 97, 98, 100, 16/102, 105, 106, 107; 49/425

[56] References Cited

U.S. PATENT DOCUMENTS

| | | | |
|---|---|---|---|
| 219,194 | 7/1979 | Allison . | |
| 2,664,598 | 1/1954 | Greig | 16/100 X |
| 2,980,947 | 4/1961 | Rust et al. | 16/100 X |
| 3,033,285 | 5/1962 | Banner . | |
| 3,085,298 | 4/1963 | Metzger | 49/425 X |
| 3,670,357 | 6/1972 | Steigerwald | 16/100 X |
| 3,745,706 | 7/1973 | Stermac | 49/425 |
| 3,956,854 | 5/1976 | Yamamoto | 16/100 X |
| 4,064,592 | 12/1977 | Riegelman et al. . | |

FOREIGN PATENT DOCUMENTS

| | | | |
|---|---|---|---|
| 437040 | 11/1967 | Switzerland | 16/90 |

OTHER PUBLICATIONS

Alcan Building Products Drawing, Part No. OSD-46, Sep. 20, 1976.

*Primary Examiner*—Fred Silverberg
*Attorney, Agent, or Firm*—Cooper, Dunham, Griffin & Moran

[57] ABSTRACT

For slidably mounting a panel such as a door on a railed track, a roller assembly including a roller having a peripheral groove for sliding on the track rail, housing structure for mounting the roller in the panel, and a rigid metal stabilizer element carried by the housing structure and having a grooved or notched extremity for overlying the rail, in tandem relation to the roller, to prevent derailment of the roller. The stabilizer element is vertically slidable in the housing structure so as to ride smoothly along the rail, accommodating local irregularities or variations in rail height.

8 Claims, 9 Drawing Figures

ROLLER ASSEMBLY WITH STABILIZER ELEMENTS FOR SLIDING PANELS

BACKGROUND OF THE INVENTION

This invention relates to roller assemblies for guiding panels, such as doors and the like, slidably along a railed track. More particularly, it is directed to such assemblies incorporating new and improved means for preventing roller derailment.

It is conventional to mount a sliding door in a door frame or opening having a railed track facing and parallel to the bottom edge of the door, and to provide in the bottom edge portion of the door two or more grooved rollers for riding on the rail of the track to guide the door in smooth sliding movement along the track. Advantageously, the rollers are fabricated of a relatively, low-friction material such as nylon. In one known form of construction, described for example in U.S. Pat. No. 4,064,592, each roller is rotatably mounted in a U-shaped housing member which is itself pivotally carried by an outer housing or bracket mounted in the door, so that the angular position of the U-shaped member relative to the outer housing can be adjusted (to locate the roller at the proper height for a particular installation) by means of an adjusting screw carried in the outer housing and bearing against the U-shaped member.

Roller-mounted sliding doors are susceptible to lateral displacement or derailment, e.g. under conditions of severe wind loading such as may be encountered during heavy storms, especially because the low-friction characteristics of the rollers (though desirable for smooth door movement) enable them to jump or slip quite easily off the track rails. Various expedients have accordingly heretofore been proposed to prevent derailment of sliding doors.

One such expedient involves the provision of vertical flanges on the tracks for engaging the bottom edge portions of the doors to retain the doors on the tracks. These flanges, however, constitute upwardly projecting obstacles which are hazardous to persons walking through the door openings, as well as being aesthetically unattractive and vulnerable to bending or other damage. In this regard, it may be mentioned that in a currently preferred track configuration, herein termed a "flat track," the track rail on which the rollers ride is recessed between parallel horizontal lands, thereby to protect the rail from damage, minimize hazards to walkers, and present a pleasingly unobtrusive appearance.

Since the track rail is commonly formed as an upstanding web having an enlarged lip or bead at the top for engagement by the rollers, it has also been proposed to provide derailment-inhibiting retainer elements that extend downwardly from the axle of and in overlapping relation to each roller (as described in the aforementioned U.S. Pat. No. 4,064,592, and in U.S. Pat. No. 3,033,285), or elsewhere along the bottom edge of the door (as described in U.S. Pat. No. 3,745,706), to hook under the rail lip or bead. The use of these devices tends to increase the difficulty of installing and especially of removing the doors to which they are attached; moreover, their ability to withstand door-displacing forces is limited, owing to the fact that they must be flexible in order to facilitate such installation and removal.

Additionally, elements mounted separately from the rollers along the bottom edge of a door, and having downwardly-opening grooves or notches for the rails, have been proposed and employed for retaining sliding doors on their tracks. An example of this type of device is a rigid metal lug adapted to be force-fitted into the lower end of a vertical stile of a sliding door. A structurally somewhat similar element is described in U.S. Pat. No. 3,085,298. Such devices must be individually mounted and positioned with considerable care, contributing to the complexity of door installation, and giving rise to the possibility that an installer in the field may inadvertently omit them, with the result that the installed door is unprotected against derailment.

SUMMARY OF THE INVENTION

The present invention is broadly directed to improvements in a roller assembly, for slidably mounting a panel (e.g. a door) on a horizontal guide track having a rail facing and parallel to one edge of the panel, of the type including a roller having a peripheral groove for bearingly receiving the rail, and means for rotatably mounting the roller, the mounting means being mountable in the panel with the roller positioned to receive the rail in its peripheral groove as aforesaid. In this broad sense, the invention contemplates the provision, in such a roller assembly, of a rigid stabilizer element carried by the mounting means of the assembly and having a generally U-shaped extremity positioned for overlying the rail in tandem relation to the roller. The U-shaped extremity has spaced legs respectively disposed to project on opposite sides of the rail in laterally overlapping relation thereto, for preventing lateral displacement of the roller relative to the rail, when the mounting means of the assembly is mounted in the panel and the rail is received in the roller groove.

In particular embodiments of the invention, the U-shaped extremity has a bridging portion between the legs for engaging the rail, and the stabilizer element is freely vertically movable in the mounting means at least through a substantial range of positions so as to ride floatingly on the rail, with the bridging portion engaging the rail. Advantageously, the bridging portion is constituted of a material (e.g. nylon) providing a low-friction surface for ease of sliding contact of the bridging portion with the rail, and the legs are constituted of metal with exposed metal inner side surfaces disposed to face the sides of the rail but spaced apart sufficiently to be ordinarily out of contact with the rail. Thus, in a preferred or convenient form, the stabilizer element comprises a rigid metal body and an insert of low-friction material mounted therein to constitute the bridging portion. Preferably, also, the legs and the bridging portion cooperatively define a downwardly opening groove or notch deeper than the peripheral groove of the roller, and the legs have straight horizontal lower edges.

Further in accordance with the invention, in specific embodiments thereof, the mounting means includes vertical wall portions defining an open-ended vertical passage for the stabilizer element, which is dimensioned to fit in the passage for vertical sliding movement relative to the mounting means while being restrained by the wall portions against horizontal movement in any direction relative to the mounting means. Conveniently or preferably, in such embodiments, the stabilizer element has a vertically elongated transverse opening above the U-shaped extremity, and one of the passage-defining wall portions of the mounting means bears a stop projection disposed within the transverse opening for limiting the extent of upward and downward movement of the stabilizer element by interferingly engaging lower and upper edges of the transverse opening. In roller assemblies wherein the mounting means includes a U-shaped inner housing carrying the roller and pivotally mounted in an outer housing, with an adjusting screw carried in a rear wall of the outer housing for bearing endwise against the inner housing to set the angular position of the inner housing, the rear wall of the outer housing may constitute one of the aforementioned vertical wall portions defining the passage for the stabilizer element, and the adjusting screw may be arranged to project into the passage so as to constitute the stop projection.

Directional terms such as "horizontal," "vertical," "forwardly," "rear," "rearwardly," and the like are to be understood as used herein only in a relative sense, i.e., to specify relative positions of the elements of the assembly, and not as limiting the assembly to any particular orientation in use. Also, it is to be understood that the term "low friction" is used herein to refer to materials and surfaces which slide substantially more easily (i.e. with a lower coefficient of kinetic friction) on a metal rail than do metal surfaces.

In the roller assembly of the invention, the stabilizer element, being a rigid body, provides fully effective restraint of the panel against derailment even under heavy wind loadings or other forces directed laterally against the panel, because the legs of its U-shaped extremity interferingly engage the rail to prevent such derailment even if the roller might otherwise tend to slip off the rail. The tandem arrangement of the roller and stabilizer (one behind the other along the rail) permits the stabilizer, even though mounted with the roller, to be of the type in which derailment is prevented by interfering engagement between its legs and the sides of the rail, rather than by hooking under a projecting bead or lip of the rail, and thereby facilitates installation and removal of the panel, while enabling use of a fully rigid stabilizer that can most effectively prevent derailment. The provision of the stabilizer on the roller assembly greatly simplifies mounting, because only a single operation is needed to mount and position both the stabilizer and the roller, and there is no possibility of omitting the stabilizer.

The arrangement of the stabilizer element for free-floating vertical movement relative to the mounting means, with a bridging portion of the U-shaped extremity riding on the rail, makes the stabilizer element entirely self-adjusting in position. In this arrangement, the use of a low-friction material for the bridging portion (as well as the spacing of the metal legs of the U-shaped extremity so that they are normally out of contact with the rail) minimizes frictional resistance to the desired smooth sliding movement of the panel and enables the stabilizer element to slide easily, raising and lowering itself, over humps and other irregularities in rail height. At the same time, use of metal for the legs is also beneficial because frictional forces between the metal legs and metal rail (when contact between them occurs) make the stabilizer less vulnerable than a low-friction roller to slipping off the rail. The provision, in the U-shaped extremity, of a groove deeper than the roller groove, with legs having straight horizontal lower edges, maximizes the extent of lateral overlap of the rail by the legs, thereby to enhance the resistance of the stabilizer to derailment. Positioning of the stabilizer in a vertical passage of the mounting means, with a stop projection to limit vertical movement, facilitates manufacture of the assembly and prevents the stabilizer from falling out of the assembly before or during installation. Overall, the structure and arrangement of the elements in the preferred specific embodiment provide a beneficially simple, economical and virtually foolproof construction which is easy to manufacture, to install, and to adjust.

Further features and advantages of the invention will be apparent from the detailed description hereinbelow set forth, together with the accompanying drawings.

DETAILED DESCRIPTION

Figure 1:
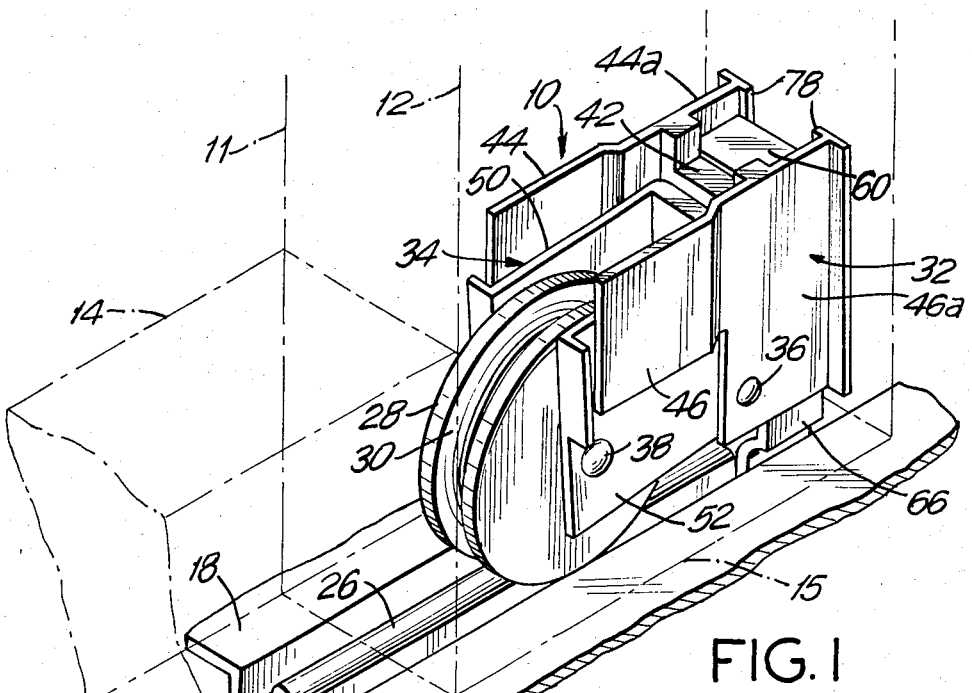
FIG. 1 is a perspective view of a roller assembly embodying the present invention in a particular form.

Referring to the drawings, the invention will be described as embodied in a roller assembly 10 mountable in a sliding door represented in FIG. 1 by a schematic, fragmentary, phantom line showng of a corner portion of a conventional sliding door 11 including a vertical stile 12 and a bottom rail 14. As installed in a door frame or opening, the door 11 is positioned with its bottom horizontal edge 15 disposed above a straight horizontal flat track 16 of known type mounted on a floor or sill (not shown) so as to extend beneath, parallel to, and in facing relation to the bottom edge 15 of the door. This track includes two spaced, parallel, upwardly facing horizontal lands 18 and 20, between which is disposed a recessed rail 22 comprising an upstanding web 24 formed with an enlarged bead 26 at the top, the bead being essentially flush with the lands. Conveniently, the track is an extruded aluminum member.

Figure 3:
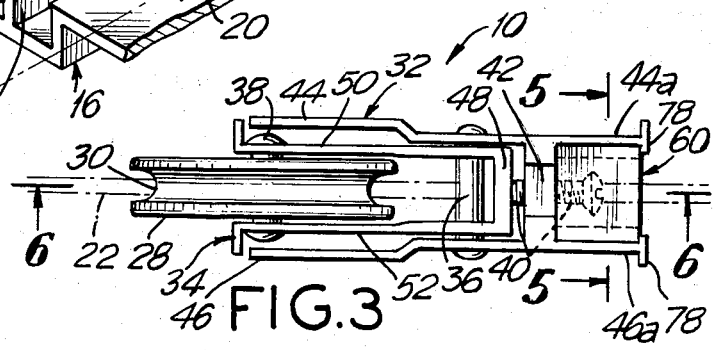
FIG. 3 is a top plan view of the FIG. 1 assembly.

The assembly 10 includes a nylon roller 28 having a peripheral groove 30 which, when the assembly is mounted in the door 11 adjacent the lower edge thereof, is positioned to receive and bear against the bead 26 of the rail 22 so that the roller rides on the rail, guiding the door for sliding movement along the track. In addition, the assembly includes a housing structure comprising an outer housing 32, an inner housing 34, a pivot pin 36 connecting the inner and outer housings for relative angular movement about a first horizontal axis perpendicular to the direction of sliding movement of the door, an axle 38 supporting the roller in the inner housing for rotation about a second horizontal axis parallel to but spaced forwardly from the aforementioned first axis, and an adjusting screw 40 (FIGS. 3, 6 and 7) for selectively setting the relative angular positions of the inner and outer housings.

In this assembly, the outer housing 32 is a rigid, generally U-shaped metal member having a vertical rear wall 42 and spaced vertical side walls 44 and 46, being open at the top, bottom and front. The inner housing 34 is similarly a rigid U-shaped metal member with a vertical rear wall 48 and vertical side walls 50 and 52 and is likewise open at the top, bottom, and front, being disposed between the side walls of the outer housing forwardly of the rear wall 42, i.e. in nested relation to the outer housing, and being dimensioned to fit with clearance therein. The pivot pin is located adjacent the lower rear corner of the inner housing 34 but forwardly of the rear wall thereof, extending through the inner and outer housing side walls 44, 50, 46 and 52, so as to interconnect the inner and outer housings for relative anuglar movement as described. Such angular movement is limited, however, to a few degrees (from a position in which the rear walls of the two housings are parallel), in both clockwise and counterclockwise directions as viewed in FIG. 6, by interfering engagement of the inner and outer housing rear walls. In addition, the adjusting screw 40 is threaded through an opening in the rear wall 42 of the outer housing so that its end or nose bears against the rear wall 48 of the inner housing, acting as a stop to limit clockwise anuglar movement of the inner housing (as viewed in FIG. 6) relative to the outer housing at a point determined by the extent to which the screw projects forwardly of wall 42.

Figure 2:
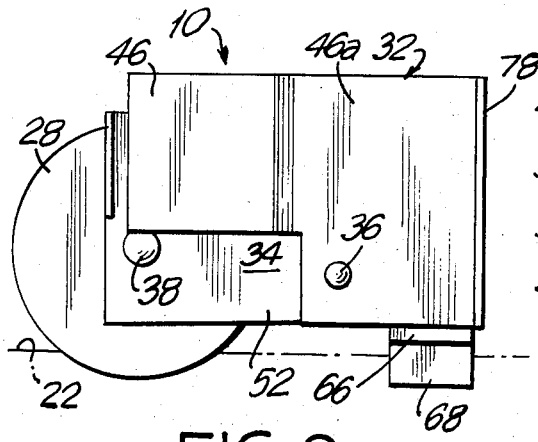
FIG. 2 is a side elevational view of the assembly of FIG. 1.
Figure 4:
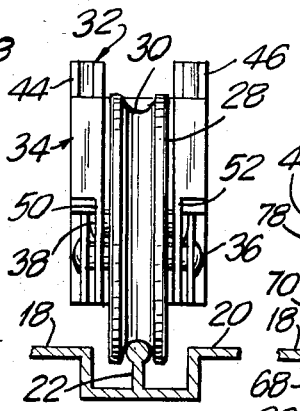
FIG. 4 is a front elevational view of the same assembly.

The axle 38 extends between and is mounted in the inner housing side walls 50 and 52 adjacent the forward end of the assembly, i.e. forwardly of and above the level of the pivot pin 36. The roller 28, rotatably supported on this axle, projects substantially below the lower margin of the housing walls so as to be exposed for engagement with the track rail 22, the position of which (relative to the roller, in an installed door) is illustrated in section in FIG. 4 and in phantom lines in FIGS. 2, 3 and 6.

For use of the assembly, the outer housing 32 is fixedly mounted in the door 11 adjacent the bottom edge of the door, e.g. in the vertical stile 12 as shown in FIG. 1 with the roller positioned to engage and ride on the track rail 22 and the rear of the housing 32 facing the exposed vertical edge of the stile to facilitate access to the adjusting screw 40 through an opening (not shown) in the latter stile edge. The manner of mounting the housing 32 in the door may be entirely conventional, and suitable arrangements for such mounting will be readily apparent to persons of ordinary skill in the art, it being understood that the housing 32 is typically fixed in the door with its rear and side wall surfaces oriented substantially in vertical planes.

As long as the roller 28 is not bearingly engaging the track rail 22, the inner housing 34 is free to pivot downwardly (counterclockwise, as viewed in FIG. 6) relative to the outer housing 32 about pin 36 until arrestd by interfering engagement of the rear walls 42 and 48. When the roller receives the rail 22 in groove 30 and the weight of the door bears on it (through housing 32, pin 36, housing 34, and axle 38), however, the inner housing is forced clockwise (upwardly) to the upper limit of its angular travel, and there remains so long as the door rides on the track. This upper limit, determined as explained above by the position of screw 40, is adjusted during installation to vary the elevation of the roller relative to the door, or in other words to increase or decrease the distance to which the roller protrudes vertically below the door bottom edge 15, until a proper fit of the door with its rollers in the door frame or opening is achieved. Typically, each sliding door panel carries two of the roller assemblies 10, respectively adjacent opposite ends of its bottom edge, providing balanced support for the door on the track.

In this typical case, the weight of the door is borne on the two rollers, which bearingly receive the bead 26 of rail 22 in their grooves and roll therealong, when the door is pushed lengthwise of the track, to guide the door in sliding movement. The low-friction characteristic of the nylon of which the rollers are made contributes to the ease and smoothness of movement of the doors. However, owing in part to this same property, the rollers are susceptible to becoming derailed (slipping sidewise off the rail 22) when the door is subjected to strong lateral forces, such as the severe wind loading that may occur in hurricanes, gales, or even lesser storms. Derailment commonly results in complete dislodgement of the door, which is especially undesirable during heavy weather conditions, may cause damage to the door itself or other objects, and in any event necessitates awkward and inconvenient reinstallation of the door.

The assembly 10, insofar as described above, is generally conventional in construction, installation, and use. Particular features of the invention, now to be set forth, reside in the combination therewith of new and improved means for preventing derailment of the roller 28.

In the form shown, the improvement in accordance with the invention comprises the provision of a rigid stabilizer element 60 disposed within the outer housing 32 rearwardly of the rear wall 42 and between the side walls 44 and 46 thereof. Conveniently, the element 60 includes an integral body 62 of aluminum, having an upper portion 64 of vertically elongated rectangular solid configuration and a generally U-shaped extremity 66 at the lower end of the portion 64. This U-shaped extremity is formed with a pair of downwardly projecting parallel legs 68, between which there is fixedly disposed a low friction (e.g. nylon) insert 70, with a concavely arcuate lower surface 71, constituting a bridging portion between the legs and defining therewith a downwardly opening groove or notch 72 having a depth greater than the depth of the roller groove 30. The lower edges 74 of the legs are preferably straight and horizontal, and are parallel to the axis of curvature of surface 71.

Figure 5:
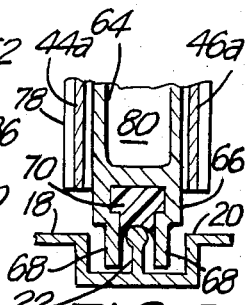
FIG. 5 is as fragmentary sectional elevational view taken as along the line 5—5 of FIG. 3.

The U-shaped extremity 66 is disposed to overlie the track rail 22, in tandem relation to (behind) the roller 28, such that the rail 22 lies within the groove or notch 72, engaged by the surface 71 of the nylon insert 70, and the legs 68 respectively extend downwardly, on opposite sides of the rail, in laterally overlapping relation thereto. The inner surfaces of the legs 68, respectively facing the opposite sides of the rail, are exposed bare metal surfaces. The spacing between the legs 68 is such, however, that there is ordinarily no contact between the legs 68 and the rail 22, but rather a complete though small clearance between them, as shown in FIG. 5. Thus, the sliding movement of the door on its rollers is not hindered by the frictional resistance that would result if there were metal-to-metal contact between the bare metal stabilizer legs and the rail. As the door moves, the nylon insert 70 of the stabilizer rests against and slides along the top of the rail 22, but since the insert is made of low friction material its contact with the rail does not impede desired free sliding movement of the door.

In the illustrated assembly, the upper portion 64 of the stabilizer element 60 is received within a vertical, open-ended passage 76 of uniform rectangular cross-section, defined by the planar vertical rearwardly-facing surface of the rear wall 42 of the outer housing 32, planar vertical inwardly-facing surfaces of portions 44*a* and 46*a* of the outer housing side walls which extend rearwardly of wall 42, and a pair of spaced vertical flanges 78 formed on the rear vertical edges of the outer housing wall portions 44*a* and 46*a*. The dimensions of passage 76 are such as to permit free-floating vertical sliding movement of the stabilizer element 60 in either direction (up or down) relative to the housing 32, but to restrain the element 60 against horizontal movement in any direction.

Figure 6:
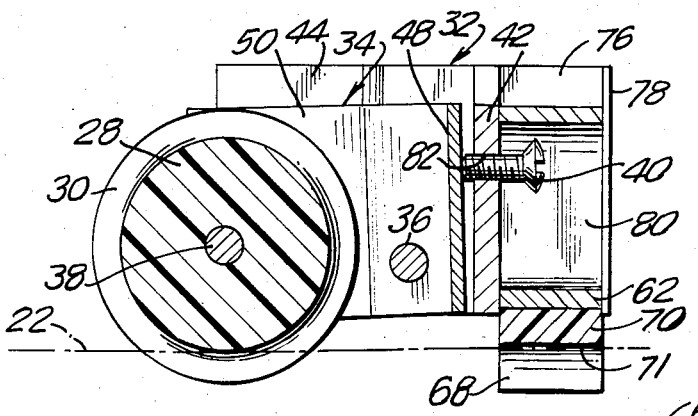
FIG. 6 is a sectional elevational view taken along the line 6—6 of FIG. 3.
Figure 8:
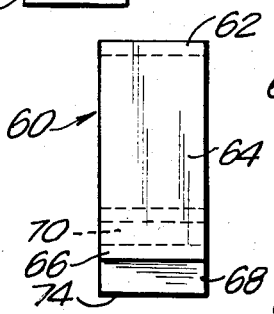
FIG. 8 is an enlarged side elevational view of a stabilizer element suitable for use in the assembly of FIG. 1.
Figure 7:
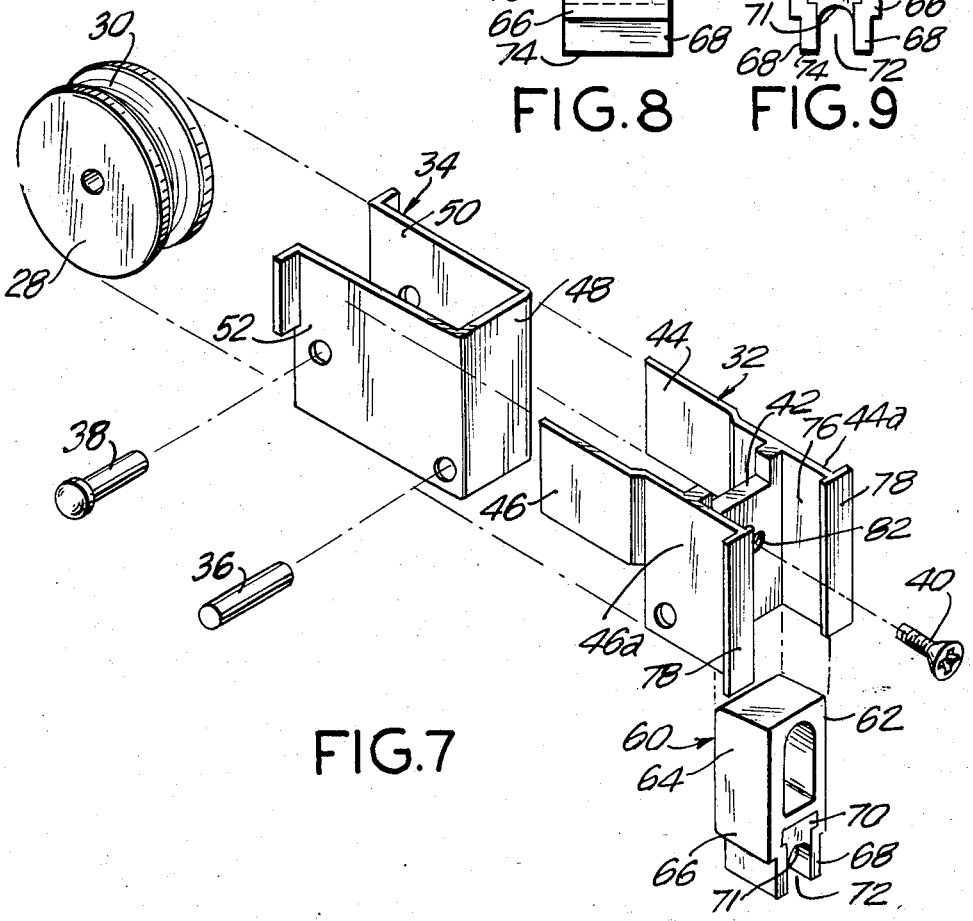
FIG. 7 is an exploded perspective view of the assembly of FIG. 1.

The portion 64 of element 60 has a vertically elongated front-to-rear opening 80 above the U-shaped extremity. When the adjusting screw 40 is threaded through the screw hole 82 (FIG. 7) provided in wall 42, so as to bear endwise against the rear wall 48 of the inner housing 34, the head of the screw (as best seen in FIG. 6) projects rearwardly of the wall 42, i.e. into the passage 76; with the stabilizer element 60 in place in the passage 76, the head portion of the screw is received within the opening 80, which has a greater vertical extent than the screw head. Thus, the element 60 is free to move up and down between upper and lower limits respectively established by interfering engagement of the screw head with the lower and upper edge surfaces of the opening 80. The disposition and vertical dimensions of the opening 80 are selected to locate these upper and lower limits outside the range of vertical travel through which the stabilizer element may move, with the insert 70 riding on the rail 22, in any position to which the roller 28 and housing 34 may be adjusted.

In the manufacture of the described roller assembly, the stabilizer element is first inserted in the passage 76 (with the U-shaped extremity oriented downwardly), until the opening 80 comes into register with the screw hole 82 in the wall 42. The screw 40 is then inserted forwardly through the gap between the flanges 78 and through the opening 80 and threaded in the screw hole; as will be appreciated, this gap and opening provide access both for initial insertion of the screw and for subsequent adjustment of the screw (to vary the position of the roller 28) with a screwdriver. The screw acts as a stop projection, preventing the stabilizer element 60 from dropping out of the housing 32 prior to or during installation of the roller assembly, while permitting the element 60 to move freely through the full range of vertical sliding movement necessary to enable it to continuously ride on the rail 22 at any position of roller 28.

Figure 9:
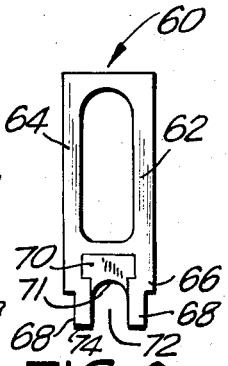
FIG. 9 is a similarly enlarged front elevational view of the stabilizer element of FIG. 8.

The element 60 may conveniently be produced by extruding an elongated aluminum section having the profile of the body 62, pouring in nylon between the legs 68 to form the insert 70, and cutting the extruded section (with the contained insert) transversely into individual stabilizer elements. As best seen in FIG. 9, the gap between legs 68 is enlarged at the top (i.e. the inner surface of each leg 68 is offset outwardly in its upper portion) to assist in positively retaining the insert 70 in place.

Owing to its freedom of vertical sliding movement in the passage 76, the stabilizer element 60 is entirely self-adjusting. When the roller assembly 10 is installed in a door and a rail 22 is received in the groove of the roller 28, the element 60 simply drops (by gravity) into the position in which the surface of the nylon insert 70 engages the rail, and continues thus to rest on the rail (by virtue of its freedom to float up and down in the housing 32) regardless of any positional adjustment of the roller 28 relative to the door.

As the door is moved along the track 16, the insert surface 71 of the stabilizer element glides along and in continuous floating contact with the rail. The stabilizer simply rises or descends in the passage 76 as it passes over bumps or other irregularities of height in the rail.

In the event of high wind or other strong lateral force exerted against the door (viz. a force having a significant component in a direction transverse to the major surfaces of the door), one or the other of the stabilizer legs 68 comes into interfering engagement with a side of the track 22, thereby preventing derailment of the adjacent roller 10. Contributing to the effectiveness of the stabilizer are the rigidity and the relatively high friction characteristics of its constituent material (metal); the extended region of engagement of its upper portion 64 with the passagedefining wall portions of housing 32; and the depth of the groove 72 and the straight lower edges of the legs 68, which maximize the extent to which the legs laterally overlap the rail.

It is to be understood that the invention is not limited to the features and embodiments hereinabove specifically set forth but may be carried out in other ways without departure from its spirit.

I claim:

1. A roller assembly unit adapted for installation in a panel for slidably mounting the panel on a horizontal guide track having a rail facing and parallel to one edge of the panel, comprising:

(a) a roller having a peripheral groove for bearingly receiving the rail;

(b) means for rotatably mounting said roller, said mounting means being mountable in the panel with said roller positioned to receive the rail in said peripheral groove as aforesaid; and (c) a rigid stabilizer element, carried by said mounting means, having a generally U-shaped extremity positoned for overlying the rail in tandem relation to said roller, said U-shaped extremity having spaced legs respectively disposed to project on opposite sides of the rail in laterally overlapping relation thereto, for preventing lateral displacement of the roller relative to the rail, when said mounting means is mounted in the panel and the rail is received in the roller groove, said U-shaped extremity having a bridging portion between said legs for engaging the rail when said legs project on opposite sides of the rail as aforesaid, said bridging portion being constituted of a material providing a low-friction surface for ease of sliding contact of the bridging portion with the rail, and said stabilizer element being freely vertically movable in said mounting means at least through a substantial range of positions such that the stabilizer element rides floatingly on the rail, with said bridging portion engaging the rail, when said mounting means is mounted in the panel and the rail is received in the roller groove, (d) said mounting means including vertical wall portions defining an open-ended vertical passage and said stabilizer element being dimensioned to fit in said passage for vertical sliding movement relative to said mounting means while being restrained by said wall portions against horizontal movement in any direction relative to said mounting means;

(e) said stabilizer element having a vertically elongated transverse opening above said U-shaped extremity, said transverse opening having upper and lower edges; and (f) one of said wall portions of said mounting means bearing a stop projection, of lesser vertical extent than said transverse opening, disposed within said transverse opening for limiting the extent of upward and downward movement of the stabilizer element by interfering engagement of the stop projection with said lower and upper edges of said transverse opening.

2. An assembly unit as defined in claim 1, wherein said legs and said bridging portion cooperatively define a downwardly opening groove or notch deeper than the peripheral groove of said roller.

3. An assembly unit as defined in claim 2, wherein said legs of said U-shaped extremity have straight horizontal lower edges.

4. An assembly unit as defined in claim 1, wherein said legs are constituted of metal with exposed metal inner side surfaces disposed to face the sides of the rail but spaced apart sufficiently to be ordinarily out of contact with the rail when said mounting means is mounted in the panel and the rail is received in the roller groove.

5. An assembly unit as defined in claim 4, wherein said stabilizer element, including said legs, comprises a rigid metal body and an insert of low-friction material mounted in said rigid metal body to constitute said bridging portion.

6. An assembly unit as defined in claim 1, wherein the material of the bridging portion is nylon.

7. An assembly unit as defined in claim 1, wherein said mounting means comprises an outer housing mountable in the panel adjacent said one edge thereof, an inner housing received within said outer housing and carrying said roller for rotation about a first horizontal axis, pivot means for mounting the inner housing in the outer housing for angular movement relative thereto about a second axis parallel to but spaced from the first axis, and a screw for adjustably setting the angular position of said inner housing relative to said outer housing through a limited range of positions thereby to vary the position of the roller relative to the panel; wherein said outer housing and said inner housing are both rigid, generally U-shaped members each having a rear wall and vertical side walls, the rear wall of the outer housing being positioned to interferingly engage the rear wall of the inner housing to limit the extent of relative angular movement of the two housings; wherein said screw is carried in the rear wall of the outer housing for bearing endwise against the rear wall of the inner housing to settably limit the range of angular movement of the inner housing; and wherein said rear wall of the outer housing constitutes one of said passage-defining vertical wall portions and said adjusting screw projects therefrom into said passage to constitute said stop projection.

8. An assembly unit as defined in claim 1, wherein said mounting means includes a unitary housing element supporting said roller and carrying said stabilizer element, said housing element being mountable in said panel.

* * * * *